United States Patent [19]

Reinlein et al.

[11] Patent Number: 4,534,311

[45] Date of Patent: Aug. 13, 1985

[54] APPARATUS FOR ELECTROSTATIC SPRAY-ENAMELING

[75] Inventors: Karl-Heinz Reinlein, Dettelbach; Bruno Stäblein, Würzburg, both of Fed. Rep. of Germany

[73] Assignee: Fulguvit GmbH & Co. K.G., Wunstort, Fed. Rep. of Germany

[21] Appl. No.: 561,927

[22] Filed: Dec. 15, 1983

[30] Foreign Application Priority Data

Dec. 16, 1982 [DE] Fed. Rep. of Germany ..... 3246574

[51] Int. Cl.[3] ..... B05D 1/04

[52] U.S. Cl. ..... 118/630; 118/634; 427/27; 427/32; 427/33

[58] Field of Search ..... 118/630, 634; 427/27, 427/32, 33

[56] References Cited

U.S. PATENT DOCUMENTS 2,447,664 8/1948 Pegg ..... 118/634
2,723,921 11/1955 Starkey ..... 118/630
2,847,324 8/1958 Ogint ..... 118/634
3,996,410 12/1976 Gruetzman ..... 427/27
4,377,603 3/1983 Itoh et al. ..... 118/630

*Primary Examiner*—Richard Bueker
*Attorney, Agent, or Firm*—Wells & Wells

[57] ABSTRACT

Enameling of long, bar-shaped objects such as shaped sections for doors and/or windows made of plastic or of plastic coated metals shall be made possible in a simple manner without additional, time-consuming manual operations by means of an apparatus for electrostatically spray-enameling plastic parts in a spray booth while employing a conducting liquid which prior to the enameling process is deposited by spraying on the surfaces of the parts.

To that end the invention provides at least one roller conveyor before and after the spray booth, at least one part of the conveyor rollers being driven and the conveyor rollers, which preferably are made of steel, simultaneously acting as current returns and being grounded.

17 Claims, 9 Drawing Figures

APPARATUS FOR ELECTROSTATIC SPRAY-ENAMELING

BACKGROUND OF THE INVENTION

The invention concerns an apparatus for electrostatic spray-enameling plastic parts in a spray booth using a conducting liquid spray-deposited on the parts surfaces prior to enameling.

Deposition of a conducting liquid on the surface of the plastic parts is required in electrostatic enameling because the plastic parts are insulators which as such do not allow electrostatic enameling. Accordingly the conducting liquid forms the required opposite pole permitting the apposition of the charged paint particles on the surface of the plastic parts.

The conducting liquid is a solution of polar conducting substances in highly volatile alcohols. Thus the conducting liquid consists of a solvent and a vehicle, the solvent of the solution uniformly distributing the vehicle during deposition.

In a known apparatus the objects to be enameled are made to pass with so-called hangers through a spray booth, for which they must be individually suspended into the conveyor hooks of the hangers before enameling and then be removed from these hooks after enameling.

However such a conveying system is inapplicable where long, bar-shaped sections are involved because these bar-shaped components would too strongly warp at their ends when suspended or because requiring laborious suspension at several places along their length. The latter eventuality in particular incurs the drawback that additional points of contact would be created which would be inaccessible to the enamel and therefore subsequent enameling would be required at those places.

SUMMARY OF THE INVENTION

Accordingly it is the object of the invention to so design an apparatus of the initially cited kind that it makes possible enameling long, bar-shaped objects such as shaped sections for doors and/or windows and made of plastic or of plastic-coated metals and to do so in a simple manner without time-consuming additional manual processes.

This problem is solved by the invention in that at least one roller conveyor is located in front and behind the spray booth, at least part of the conveyor rollers being driven and the conveyor rollers preferably made of steel simultaneously providing a current return and being at ground.

This arrangement makes it possible to move the long, bar-shaped sections into and out of the spray booth without there being a danger that in their position as beams supported between two rests they shall excessively sag at the center and their ends. As regards the spray booth itself, there will obviously be sagging in relation to the length of the spray booth, however it is possible to so design the length of the spray booth as a function of the cross-section of the shaped sections that problem-free passage through the spray booth is assured.

In spite of this problem-free conveyance, the process of the invention assures that the grounding contact to the conveyor rollers remains intact both in front and behind the spray booth.

To-date long shaped sections of this kind were enameled by the ordinary airless spray method, whereby a substantial loss of enamel of about 70% was incurred. The apparatus of the invention offers the big advantage over these known enameling method that the enameling loss can be appreciably reduced, by about up to 100%. The invention assures that the enamel issuing from the spray heads is attracted by the shaped sections connected to the grounding conductor and is uniformly deposited on the surface of said shaped sections.

It was found to be particularly advantageous when making the electrical contact in operation that at least the particular first or last conveyor roller of the bilateral roller conveyors facing the spray booth be additionally covered with a conducting liquid. In this manner problem-free grounding is achieved even when the shaped section to be processed just enters the spray booth or leaves it. Obviously grounding is absolutely assured when the parts rest on both conveyor rollers facing the spray booth.

It is especially advantageous in this respect to deposit the conducting liquid on the particular conveyor roller by a deposition roller revolving in a tub containing the conducting liquid. Appropriately the deposition roller consists of a wear-resistant plastic which can deform enough for deposition on the conveyor roller which is a steel roller. Advantageously this plastic is a low-pressure polyethylene.

Such a combination of rollers can be mounted both at the incoming and outgoing sides of the spray booth, several such roller combinations if necessary being cascaded.

Appropriately the conveyor roller loaded with the liquid conductor can be driven directly, while the deposition roller is driven by its contact with the conveyor roller.

Advantageously the deposition roller is rotatably supported by the tub containing the conducting liquid.

The tub can be mounted in adjustable manner, for instance to pivot about a horizontal shaft. Appropriately the tub is pivotably supported between the two parallel rails supporting the conveyor roller and suspended from them. In this manner a pivoting motion of the tub changes the spacing between the conveyor and the deposition rollers and hence the compression between these two rollers. To that end an adjustment means is provided. This adjustment means may consist of at least one adjustment screw acting on that side of the tub away from the conveyor roller and beyond the pivot shaft. In this manner the particular tub position can be adapted to circumstances and resetting is possible in the case of wear.

The shaped section leaves the spray cabin coated with the still moist enamel and makes contact with the conveyor rollers beyond the booth, so that part of the enamel may deposit on the conveyor rollers which thereby will have to be periodically cleaned.

In order to cleanse the shaped sections of excess paint when leaving the spray booth, it is particularly appropriate to arrange a cleaning system on the roller combination mounted on the exit side of the spray booth and applying conductor liquid, where said cleaning system consists of at least one conveyor roller loaded with cleaning fluid.

A glycol ester of average volatility is especially applicable as the cleaning liquid.

Such a cleaning system makes it possible to detach excess paint from the shaped sections, so that the subsequent conveyor rollers will not soil.

The cleaning system appropriately comprises a tub containing the cleaning liquid and wherein revolves a brush roller applied on the associated conveyor roller. Appropriately both the brush roller and the associated conveyor roller are driven preferably in mutually opposite directions so that the conveyor roller is so-to-speak brushed off simultaneously with the deposition of the cleaning liquid and retains its full conveying function.

The tub containing the cleaning liquid can be mounted pivotably in the same manner as the tub containing the conducting liquid. The former also may be provided with an arrangement whereby the bilateral bearings of the brush roller are mounted vertically displaceably on the tub, the tub in turn being mounted in spatially fixed manner to the rails of the roller conveyor. The bearings for the brush roller can be adjusted by adjustment screws resting against the tub.

Depending on need, several of these cleaning systems can be mounted consecutively and be associated with the consecutive conveyor rollers. Preferably three such systems are provided.

Another cleaning approach is to provide a wiper in front of the conveyor roller following the spray booth in the direction of advance. Such a wiper may assume the form of an elastic stripping sheet or plate, for instance of rubber or an elastic plastic, and makes contact with the surface of the shaped section to be cleaned.

It is furthermore possible to combine such a wiper with the wiping or brush roller of the cleaning system, the wiper acting opposite the direction of rotation of the brush roller. No difficulties are encountered in scraping the excess paint off the brush roller because this brush roller arrives diluted by the cleaning liquid at the wiper.

The described arrangements as a rule provide adequate grounding contact with the subsequent roller conveyor, whereby the discharge prescribed by the profession of the enameled part does take place. To further improve and assure the discharge, an ionizing device furthermore may be provided directly at the exit of the spray booth, the ambient atmosphere being charged within the region of said ionizing device at the opposite polarity to that of the enameled shaped section, so that charge decay takes place.

Appropriately the conducting liquid is deposited on the shaped sections to be enameled in a separate deposition booth preceding the spray booth as seen in the direction of advance, the conducting liquid being deposited from all sides by air-spray guns on the transiting shaped section. It is to the point however that prior to depositing the conducting solution those segments of the lower side of the shaped sections be removed which are not to be enameled subsequently. In any even though those surfaces must be provided with conducting solution which are making contact with the conveyor rollers, in order to assure adequate grounding.

The air-spray guns can be arrayed at mutual spacings in the deposition booth. Appropriately two air-spray guns are mounted above the workpiece to be coated, with another air-spray gun operating at a slant from below against the workpiece.

Another possibility is to use four air-spray guns of which one operates from above and three more obliquely from the side from above and below on the workpiece. The air-spray guns can be mutually offset one behind the other in the direction of advance, the air-spray gun acting from above on the workpiece being located ahead of the others as seen in the direction of advance and with at least two lateral air-spray guns being arranged one behind the other.

To remove excess conducting liquid before the enamel is deposited and to avert thereby strong enamel dilution, and especially to assure that no excessive amounts of conducting liquid shall remain in narrow grooves or the like of the shaped section, the invention further provides blowing, at a specific air pressure and by means of blowing devices, the excess conducting liquid off the surface of the shaped section to be coated. A preferred embodiment of such blowing devices consists of a closed blow ring following the air-spray guns as seen in the direction of advance and provided with spaced apertures directed at a slant toward the shaped section to be enameled.

This blow ring is especially advantageous because assuring thereby that all the surface segments of the shaped section are uniformly loaded by the air stream.

It is further appropriate to provide a collecting funnel below the air-spray guns in the deposition booth for the conducting liquid that was blown off or is dripping after removal, whereby the excess conducting liquid can be used again.

Appropriately the spray booth is equipped with two high-rotation guns and one air gun for enamel supply, the air gun being appropriately mounted centrally between the two high-rotation guns. As regards the high-rotation guns, the surface of a jar revolving at a speed of about 12,000 to 15,000 rpm is deposited with enamel and due to the centrifugal force so produced the enamel is torn away beyond the rim of the jar whereby atomizing cones are generated. As regards the air gun, a atomizer jet is directed against the workpieces.

As a rule jet-producing air guns must be used to reach deep grooves or the like as the walls of such grooves form a Faraday cage preventing an unpressurized spray mist from entering the grooves. This drawback is remedied by the air gun on account of the additional kinetic energy imparted thereby to the jet.

The individual guns can be mounted in height-adjustable manner in the spray booth to adapt them to the various cross-sections of the shaped sections.

The arrangement described above as a rule requires spray booths which are relatively long. As a consequence the free ends of the workpieces being processed bend downwards inside the spray booth and the following roller conveyors thus may receive them only with more difficulty. In some circumstances shorter workpieces may dip into the booth because of the shift of the center of gravity.

To prevent these drawbacks, the invention furthermore provides that at least one support roller be mounted within the spray booth. To substantially prevent soiling this support roller by the enamel, this support roller appropriately is made of a plastic, preferably an enamel-repellant plastic such as a polyamide, but preferably polyethylene.

The support roller is appropriately supported in exchangeable manner in forks open at the top in a support structure, so it can be exchanged in one manual action, in order to eliminate any soiling.

The support roller is appropriately of the driven kind, the gear unit appropriately also consisting of an enamel-repellant plastic. In such a design one or both pivots of the support roller may be provided with pinions which upon being set into the fork automatically mesh with corresponding drive pinions of the gear unit. Several such support rollers can be mounted one behind the other in the spray booth.

Appropriately the surfaces of all the conveyor rollers are roughened on one hand to improve the advance and on the other to improve the deposition, possibly being also of a slightly concave, spherical shape.

Another possibility is to provide the surface of the conveyor rollers with a conveyor cover consisting of a fabric absorbing the conducting liquid. It must be correspondingly designed to be absorbing. Because these covers can soil, they are appropriately designed to be quickly removable, the conveyor cover in a preferred embodiment being a cylindrical sleeve fixed on the particular conveyor roller by a zipper or the like. Appropriately a fabric is selected that shrinks in the presence of a liquid, for instance a fabric used for printing rollers. In such instances the conveyor rollers provided with such sleeves must each be provided with a bath of conducting liquid.

BRIEF DESCRIPTION OF THE DRAWINGS

The invention is discussed below in closer detail in relation to the illustrative embodiments shown in the drawing.

DESCRIPTION OF THE PREFERRED EMBODIMENTS

Figure 1:
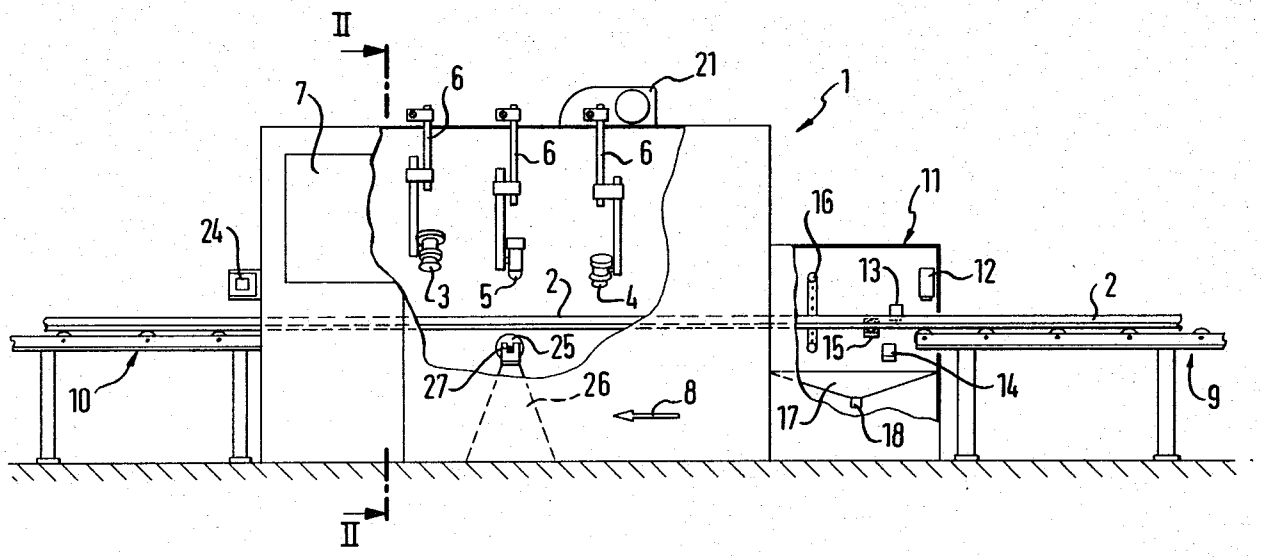
FIG. 1 is a partly cut-out sideview of an embodiment of the apparatus of the invention.

As shown in FIG. 1, two high-rotation guns 3 and 4 and an air gun 5 are provided for the supply of enamel in a spray booth 1 wherein the electrostatic enameling of plastic or plasti-coated shaped sections 2 (FIG. 2) takes place. The guns 3 through 5 are mounted on adjustable means 6 and therefore can be adapted to any particular requirements. The enameling process in the spray booth 1 can be observed through a window 7. The shaped sections 2 move through the spray booth 1 in the direction of advance rendered by the arrow 8, a feed means 9 and a removal means 10, each in the form of a roller conveyor, being associated with the spray booth 1.

Figure 8:
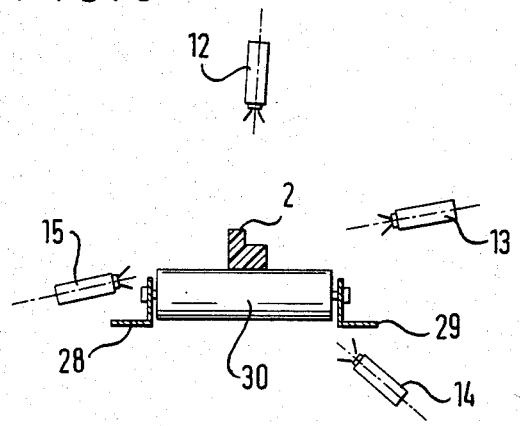
FIG. 8 is the arrangement of several air-spray guns for depositing the conducting solution.
Figure 9:
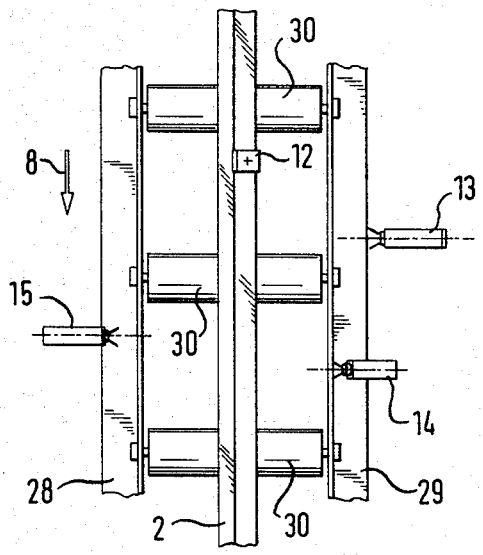
FIG. 9 is the topview of FIG. 8.

In the direction of advance, the spray booth 1 is preceded by a deposition booth 11 wherein the shaped sections 2 are provided with a conducting liquid. To that end four air-spray guns 12, 13, 14 and 15 are mounted in the illustrative embodiment shown in the deposition booth 11, of which one air-spray gun 12 operates vertically from above on the workpiece and is located, as seen in the direction of advance, ahead of the other air-spray guns, while the other air-spray guns operate laterally and obliquely on the workpiece, two of these air-spray guns 13 and 14 being mounted one behind the other (FIGS. 8 and 9).

A blowing device in the form of a closed blow ring 16 is provided to remove excess conducting liquid and for drying, the shaped sections 2 being moved through said ring 16. The blow ring 16 is provided with apertures directed obliquely toward the shaped section 2 to be enameled and arranged at mutual spacings.

A collecting funnel 17 is provided underneath the air-spray gun 12 through 15 and below the blow ring 16 within the deposition booth 11, whereby excess conducting liquid can be returned, for instance through a discharge 18, for further use.

Figure 2:
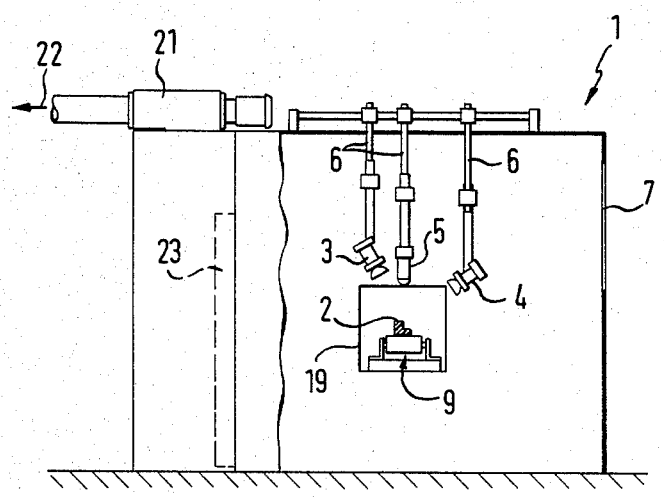
FIG. 2 is the elevation II—II of FIG. 1.

FIG. 2 is the elevation II—II of FIG. 1 and shows that the entry-side wall of the spray booth 1 is provided with an opening 19 through which the shaped sections 2 leaving the deposition booth 11 are moved, using the feed means 9, into the spray booth 1.

The spray booth 1 is provided with an air feed means 20 (FIG. 3) and comprises an air exhaust means 21 whereby the exhaust air is evacuated in the direction of the arrow 22. In order to retain dirt and enamel particles, a filter 23 is provided in the exhaust air flow between the spray booth 1 and the exhaust air means 21.

An ionizer 24 furthermore may be provided at the exit side (FIG. 1) of the spray booth 1, which charges its ambient air to the polarity opposite to that of the enameled shaped section.

Furthermore a plastic support roller 25 may be mounted inside the spray booth 1 and be rotatably supported on frames 26 whereby even thin shaped sections shall not sag. Where necessary several such support rollers 25 may be arranged, and furthermore they may also be driven. The support rollers 25 rest in upwardly open forks 27 of the support frame 26, so that they are easily exchangeable. If a drive is present, it also will be fork-shaped with its pinions on both sides of a drive-pinion of the support 25, whereby the support roller also can be removed upwards from this drive.

Figure 3:
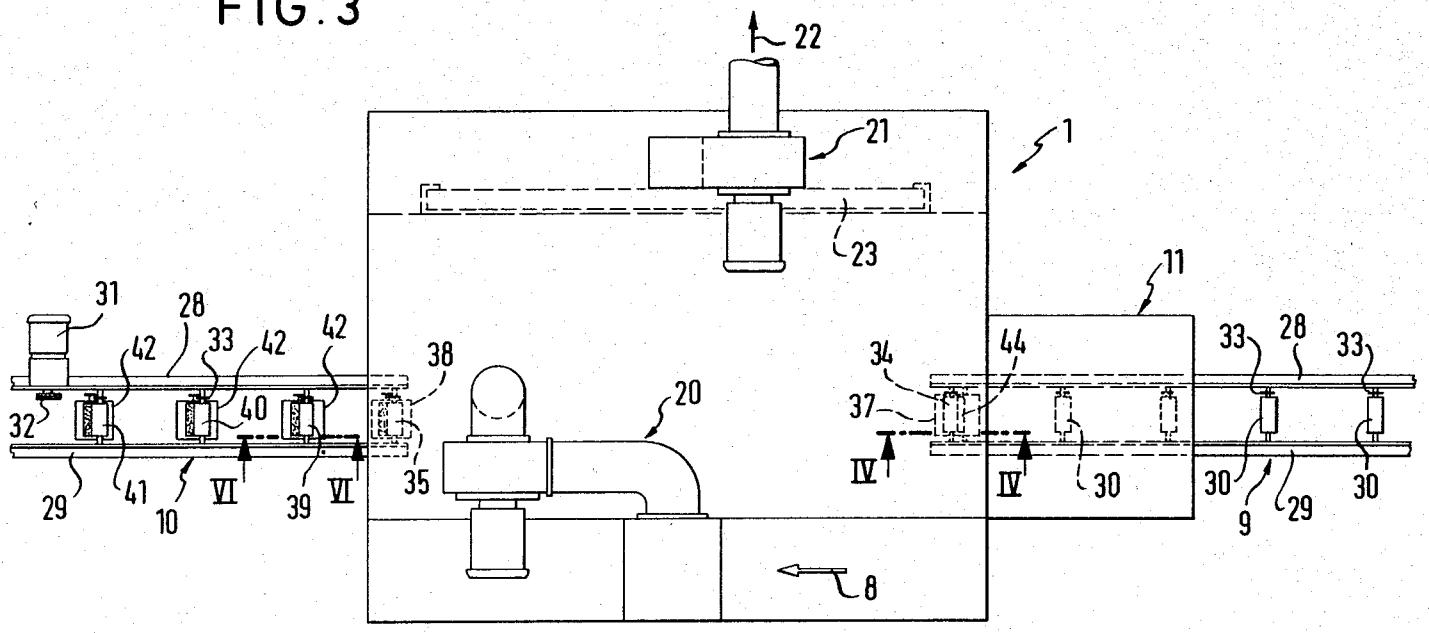
FIG. 3 is a schematic topview of the arrangement of FIG. 1.

FIG. 3 is the topview of the arrangement of FIG. 1 and in particular shows the design and arrangement of the roller conveyors 9 and 10. Guns 3 through 5 of the spray booth 1 inclusive, the associated fastening means and also the air-spray guns 12 through 15 and the blow ring 16 of the deposition booth 11 are omitted from FIG. 3.

The two roller conveyors 9 and 10 consist each of two parallel rails 28 and 29 standing on edge between which the conveyor rollers 30 are rotatably supported. As indicated schematically on the left of FIG. 3 at the removal means 10, all the conveyor rollers 30 are driven by a drive motor 31 and pinions 32 and 33. All the conveyor rollers 30 are made of steel and are grounded by means of their bearings and the rails 28 and 29.

To achieve a problem-free electrical connection in operation, the last conveyor roller 34 of the feed means 9 and the first conveyor roller 35 of the removal means 10 are additionally loaded with conducting liquid by means of the associated tubs 37 and 38 filled with conducting liquid.

Furthermore three conveyor rollers 39, 40 and 41 following—as seen in the direction of advance—the conveyor roller 35 are provided with cleaning systems also provided with tubs 42 containing a cleaning liquid.

Figure 4:
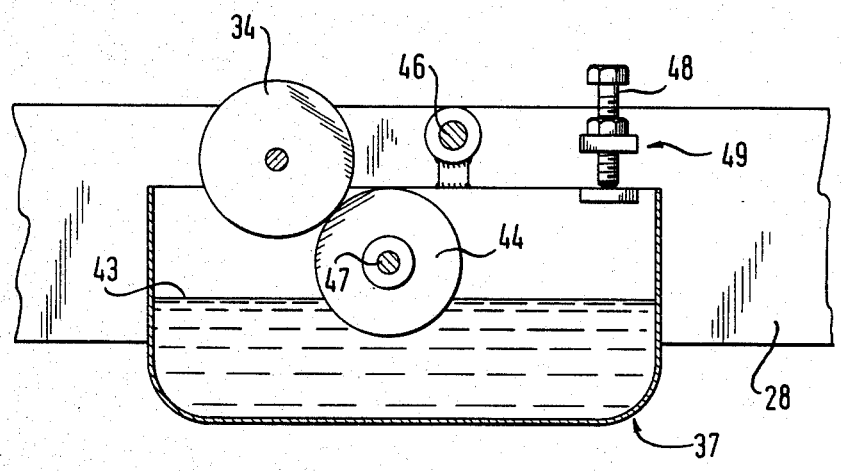
FIG. 4 is a sideview of the combination of rollers for depositing the conducting solution on a conveyor roller corresponding to the conveyor roller at the entry side of the spray booth according to the elevation IV—IV of FIG. 3.
Figure 5:
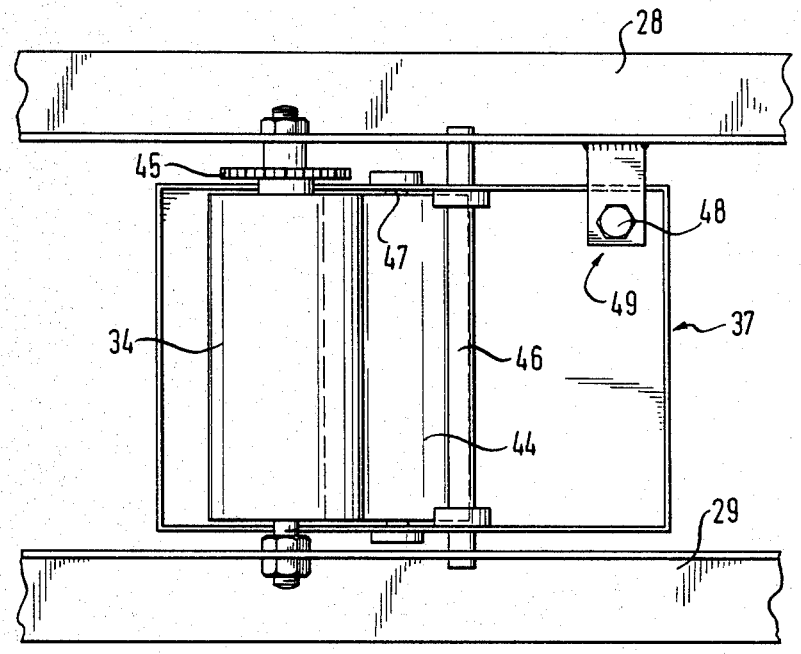
FIG. 5 is the topview of the arrangement of FIG. 4.

FIGS. 4 and 5 show one of the devices for depositing the conducting liquid on the conveyor roller 34 or 35, FIG. 4 being the elevation IV—IV of FIG. 3.

As shown by FIG. 4, the tub 37 is filled with a conducting liquid 43 into which dips a rotatably mounted deposition roller 44 making peripheral contact with the conveyor roller 34 to be loaded. The deposition roller 44 is made of a wear-resistant plastic.

FIGS. 4 and 5 render the arrangement at the entry-side of the spray-booth 1, with the arrangement at the exit-side of the spray-booth being corresponding to, but mirror-symmetrical with respect to FIG. 4, that is, the conveyor roller 35 to be loaded faces the spray booth 1.

The conveyor roller 34 is driven by a pinion 45, the drive of the deposition roller 44 being implemented by its peripheral contact with the conveyor roller 34.

This peripheral contact comes about in that the tub 37 is pivotably mounted about a horizontal shaft 46 between the two rails 28 and 29, the horizontal shaft 46 being located on the other side of the shaft 47 of the deposition roller 44, whereby the deposition roller 44 will be forced against the conveyor roller 34 when a pivoting motion takes place about the shaft 46. This is made possible by use of an adjustment 49 provided with an adjustment screw 48 acting on that side of the tub 37 away from the conveyor roller 34 and on the other side of the pivot shaft 46.

Accordingly when the conveyor roller 34 is driven, the deposition roller 44 also is set into rotation and transmits the conducting liquid 43 on the conveyor roller 34; from there any excess conducting liquid flows back into the tub 37.

Figure 6:
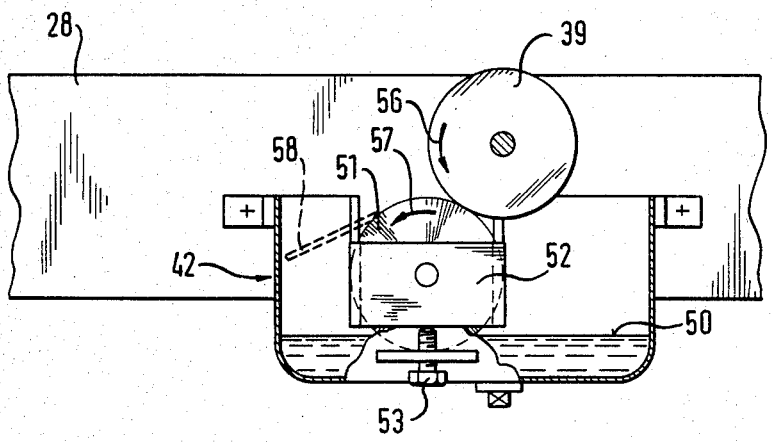
FIG. 6 is a cleaning system according to the elevation VI—VI of FIG. 3 following the first conveyor roller on the exit side of the spray booth.
Figure 7:
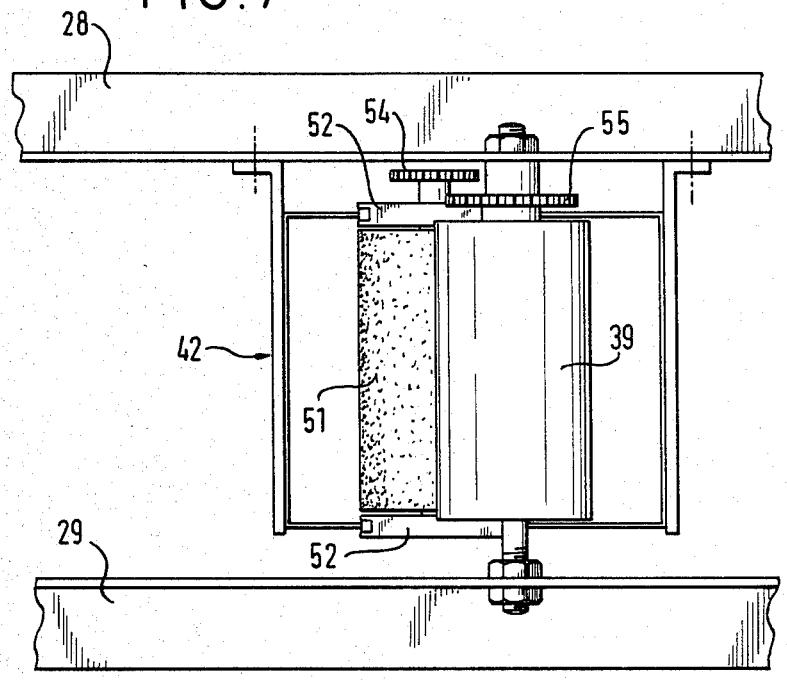
FIG. 7 is the topview of the arrangement of FIG. 6.

FIGS. 6 and 7 show one of the cleaning systems which follow, as seen in the direction of advance, the first conveyor roller 35 of the removal means 10. FIG. 6 in this regard corresponds to the elevation VI—VI and shows a tub 42 associated to the conveyor roller 39 and mounted (FIG. 7) solidly to the rail 28. The tub 42 is provided with a cleaning liquid 50 in which revolves a brush roller 51 which will be applied against the associated conveyor roller 39. Accordingly the brush roller 51 transmits the cleaning liquid 50 to the conveyor roller 39.

In the embodiment shown, the bearings 52 of the brush-roller 51 are vertically displaceable, adjustment screws 53 being provided by means of which the bearings 52 can be moved up and down.

The brush-roller 51 is driven by a pinion 54, while the conveyor roller 39 is driven by a pinion 55. As shown by FIG. 6, the two rollers 51 and 39 are driven in mutually opposite directions, whereby they rotate as indicated by the arrows 56 and 57.

Instead of displacing the bearings 52, both the tubs 42 and 37 can be pivotably supported, and vice-versa.

As indicated by the dashed lines, a wiper 58 may be associated with the brush roller acting opposite the latter's direction and removing its excess paint.

Such a wiper may also be associated with the underside of the shaped sections and follow the first conveyor roller 35 of the removal means 10.

As shown by FIG. 3, several, in particular three such cleaning systems can be mounted consecutively on the removal side.

FIGS. 8 and 9 show the arrangement of four air-spray guns 12, 13, 14 and 15 and their association with the shaped section 2 to be loaded and conveyed on the conveyor rollers 30 into the deposition booth 11 and through same. As shown by these FIGS. 8 and 9, one air-spray gun 12 is mounted above the shaped section and is located as seen in the direction of advance in front of the remaining air-spray guns 13 through 15 of which two, namely 13 and 14, are mounted so as to act obliquely from one side from above and below on the shaped section 2, being in turn mutually offset in the direction of advance. The fourth air-spray gun 15 acts obliquely from one side on the shaped section 2 and is mounted, as seen in the direction of advance, between the two mutually opposite air-spray guns 13 and 14.

We claim:

1. An apparatus for electrostatically spray enameling plastic parts comprising:
   - a spray booth,
   - means for electrostatically spraying enameling mounted in said booth,
   - at least a first roller conveyor located in front of said spray booth and adapted to feed said plastic parts to said spray booth,
   - at least a second roller conveyor located behind said spray booth and adapted to remove said plastic parts from said spray booth,
   - said first and second roller conveyors having a plurality of driven rollers,
   - said first and second roller conveyors having a plurality of electrically conductive rollers connected to ground, and
   - said first roller conveyor having at least one roller having means for applying a conducting liquid thereto.

2. An apparatus for electrostatically spray enameling plastic parts comprising:
   - a spray booth,
   - means for electrostatically spraying enameling mounted in said booth,
   - at least a first roller conveyor located in front of said spray booth and adapted to feed said plastic parts to said spray booth,
   - at least a second roller conveyor located behind said spray booth and adapted to remove said plastic parts from said spray booth,
   - said first and second roller conveyors having a plurality of driven rollers,
   - said first and second roller conveyors having a plurality of electrically conductive rollers connected to ground, and
   - said second roller conveyor having at least one roller having means for applying a conducting liquid thereto.

3. An apparatus for electrostatically spray enameling plastic parts comprising:
   - a spray booth,
   - means for electrostatically spraying enameling mounted in said booth,
   - at least a first roller conveyor located in front of said spray booth and adapted to feed said plastic parts to said spray booth,
   - at least a second roller conveyor located behind said spray booth and adapted to remove said plastic parts from said spray booth,
   - said first and second roller conveyors having a plurality of driven rollers,
   - said first and second roller conveyors having a plurality of electrically conductive rollers connected to ground,
   - said first roller conveyor having at least one roller having means for applying a conducting liquid thereto; and
   - said second roller conveyor having at least one roller having means for applying a conducting liquid thereto.

4. The apparatus of claim 3, wherein said means for applying a conducting liquid include a deposition roller mounted for revolution in a tub adapted to contain said conducting liquid and said one roller in circumferential contact with said deposition roller.

5. The apparatus of claim 4, wherein said deposition roller is composed of a wear resistant plastic.

6. The apparatus of claim 5, wherein said wear resistant plastic is low pressure polyethylene.

7. The apparatus of claim 4, wherein said means for applying a conducting liquid are in contact with said first roller conveyor.

8. The apparatus of claim 4, wherein said means for applying a conducting liquid are in contact with said second roller conveyor.

9. The apparatus of claim 7, wherein said means for applying a conducting liquid comprise a plurality of deposition rollers, tubs and are rollers in combination.

10. The apparatus of claim 8, wherein said means for applying a conducting liquid comprise a plurality of deposition rollers, tubs, and are rollers in combination.

11. The apparatus of claim 4, wherein said one roller is driven directly and said deposition roller is driven by its circumferential contact with said one roller.

12. The apparatus of claim 11, wherein said deposition roller is directly and rotatably supported by said tub.

13. The apparatus of claim 12, wherein said tub is mounted in adjustable manner.

14. The apparatus of claim 13, wherein said tub is mounted so as to pivot about a horizontal shaft.

15. The apparatus of claim 14, wherein said tub is pivotably supported by and suspended from parallel rails of said roller conveyor which support said one roller.

16. The apparatus of claim 15, further comprising an adjustment means for said tub.

17. The apparatus of claim 16, wherein said adjustment means consists of an adjustment screw acting on a side of said tub which is away from said one roller and on the other side of a pivot shaft.

* * * * *